US006786047B2

(12) United States Patent
Bland et al.

(10) Patent No.: US 6,786,047 B2
(45) Date of Patent: Sep. 7, 2004

(54) FLASHBACK RESISTANT PRE-MIX BURNER FOR A GAS TURBINE COMBUSTOR

(75) Inventors: Robert Bland, Oviedo, FL (US); Anil Gulati, Winter Springs, FL (US); John Battaglioli, Glenville, NY (US)

(73) Assignee: Siemens Westinghouse Power Corporation, Orlando, FL (US)

( * ) Notice: Subject to any disclaimer, the term of this patent is extended or adjusted under 35 U.S.C. 154(b) by 30 days.

(21) Appl. No.: 10/245,768

(22) Filed: Sep. 17, 2002

(65) Prior Publication Data

US 2004/0050057 A1 Mar. 18, 2004

(51) Int. Cl.[7] ..... F02C 1/00

(52) U.S. Cl. ..... 60/737; 60/740; 60/748; 239/433

(58) Field of Search ..... 60/732, 737, 748, 60/740; 239/433, 548, 598

(56) References Cited

U.S. PATENT DOCUMENTS

| | | | | |
|---|---|---|---|---|
| 2,920,449 | A | * 1/1960 | Johnson et al. | 60/739 |
| 4,067,190 | A | 1/1978 | Hamm et al. | |
| 4,100,733 | A | 7/1978 | Striebel et al. | |
| 4,429,527 | A | 2/1984 | Teets | |
| 4,928,481 | A | 5/1990 | Joshi et al. | |
| 4,982,570 | A | 1/1991 | Waslo et al. | |
| 5,235,814 | A | 8/1993 | Leonard | |
| 5,237,812 | A | 8/1993 | Mumford | |
| 5,319,936 | A | 6/1994 | Ikeda et al. | |
| 5,321,947 | A | 6/1994 | Sood et al. | |
| 5,372,008 | A | 12/1994 | Sood | |
| 5,475,979 | A | * 12/1995 | Oag et al. | 60/737 |
| 5,498,155 | A | 3/1996 | Chyou et al. | |
| 5,623,826 | A | 4/1997 | Ohtsuka et al. | |
| 5,655,903 | A | 8/1997 | Fischer | |
| 5,685,139 | A | 11/1997 | Mick et al. | |
| 5,822,992 | A | 10/1998 | Dean | |
| 5,836,163 | A | * 11/1998 | Lockyer et al. | 60/737 |
| 5,943,866 | A | 8/1999 | Lovett et al. | |
| 5,983,622 | A | 11/1999 | Newburry et al. | |
| 6,038,861 | A | 3/2000 | Amos et al. | |
| 6,038,864 | A | 3/2000 | Prade et al. | |
| 6,047,550 | A | 4/2000 | Beebe | |
| 6,070,410 | A | 6/2000 | Dean | |
| 6,070,411 | A | 6/2000 | Iwai et al. | |
| 6,082,111 | A | 7/2000 | Stokes | |
| 6,164,055 | A | 12/2000 | Lovett et al. | |
| 6,189,314 | B1 | 2/2001 | Yamamoto et al. | |
| 6,192,688 | B1 | 2/2001 | Beebe | |
| 6,220,034 | B1 | 4/2001 | Mowill | |
| 6,327,860 | B1 | 12/2001 | Critchley | |
| 2001/0049932 | A1 | 12/2001 | Beebe | |
| 2001/0052229 | A1 | 12/2001 | Tuthill et al. | |
| 2002/0014078 | A1 | * 2/2002 | Mandai et al. | 60/737 |

* cited by examiner

*Primary Examiner*—Charles G. Freay

(57) ABSTRACT

A pre-mixing burner (10) for a gas turbine engine having improved resistance to flashback. Fuel (32) is supplied to a pre-mixing chamber (24) of the burner from a plurality of fuel outlet openings (34) formed in fuel pegs (36) extending into the flow of air (30) passing through the chamber. The fuel outlet openings are formed to direct the fuel in a downstream direction at an angle (A) relative to the direction of the flow of air past the respective fuel peg. This angle imparts a downstream velocity vector ($V_D$) for increasing the net velocity of the air and a normal velocity vector ($V_N$) for directing the fuel away from the wake (44) formed downstream of the fuel peg. Alternate ones of the fuel outlet openings along a single fuel peg may be formed at respective positive (A) and negative (B) angles with respect to a plane (46) extending along the wake in order to minimize the size of the wake. The propensity of the burner to support upstream flame propagation and flashback is thus reduced by increasing the net air velocity, by minimizing the amount of fuel entrained in the wake, and by minimizing the size of the wake.

18 Claims, 2 Drawing Sheets

FLASHBACK RESISTANT PRE-MIX BURNER FOR A GAS TURBINE COMBUSTOR

FIELD OF THE INVENTION

This invention relates generally to the field of gas turbine engines, and more particularly to a pre-mix burner for a gas turbine engine.

BACKGROUND OF THE INVENTION

Gas (combustion) turbine engines are used for generating power in a variety of applications including land-based electrical power generating plants. Gas turbines may be designed to combust a broad range of hydrocarbon fuels, such as natural gas, kerosene, biomass gas, etc. Gas turbines are known to produce an exhaust stream containing a number of combustion products. Many of these byproducts of the combustion process are considered atmospheric pollutants, and increasingly stringent regulations have been imposed on the operation of gas turbine power plants in an effort to minimize the production of these gasses. Of particular concern is the regulation of the production of the various forms of nitrogen oxides collectively known as $NO_x$. It is known that $NO_x$ emissions from a gas turbine increase significantly as the combustion temperature rises. One method of limiting the production of nitrogen oxides is the use of a lean mixture of fuel and combustion air, i.e. a relatively low fuel-to-air ratio, thereby limiting the peak combustion temperature to a degree that reduces the production of $NO_x$. However, higher combustion temperatures are desirable to obtain higher efficiency and reduced production of carbon monoxide.

Two-stage combustion systems have been developed that provide efficient combustion and reduced NOx emissions. In a two-stage combustion system, diffusion combustion is performed at the first stage for obtaining ignition and flame stability. In diffusion combustion, the fuel and air are mixed together in the same chamber in which combustion occurs, i.e. the combustion chamber. Premixed combustion is performed at the second stage to reduce NOx emissions. In pre-mix combustion, the fuel and air are mixed together in a pre-mixer that is separate from and upstream of the combustion chamber. The first stage is referred to as the pilot stage, and it is a significant contributor to the overall amount of NOx emissions even though the percentage of fuel supplied to the pilot is comparatively small, often less than 10% of the total fuel supplied to the combustor.

It is further known to utilize a two-stage combustor wherein the pilot stage incorporates both a diffusion portion and a pre-mixed portion, as illustrated in U.S. Pat. No. 4,982,570 for example. The pre-mixer portion of such systems is easily damaged by flame flashback into the pre-mixing chamber that may occur during certain transient operating conditions.

SUMMARY OF THE INVENTION

Thus, a pre-mix burner that is resistant to the occurrence of flashback is desired. A burner for a gas turbine engine is described herein as including: a pre-mix chamber for directing a flow of air; a fuel peg extending into the flow of air, the flow of air past the fuel peg defining an upstream direction and a downstream direction; and a fuel outlet formed in the fuel peg for delivering a flow of fuel in a downstream direction transverse to the direction of the flow of air past the fuel peg. The fuel outlet may be formed to direct the flow of fuel at a 45° angle plus or minus 15° relative to a plane extending in a direction of a wake formed downstream of the fuel peg. The burner may include a plurality of fuel outlets formed along a length of the fuel peg, alternate ones of the fuel outlets being disposed at respective positive and negative angles relative to a plane extending in a direction of a wake formed downstream of the fuel peg.

A two-stage burner for a gas turbine engine is described herein as including: a diffusion burner; a structure disposed about the diffusion burner defining an annular pre-mixing chamber around the diffusion burner for the passage of a flow of air; a plurality of fuel pegs extending into the pre-mixing chamber; and a plurality of fuel outlet openings formed in each fuel peg, each fuel outlet opening directing a flow of fuel into the pre-mixing chamber in a generally downstream direction at an angle transverse to a direction of the flow of air past the respective fuel peg to direct the flow of fuel away from a wake formed in the flow of air downstream of the respective fuel peg. A majority of the fuel outlet openings of each peg may be formed within a center half of a cross-sectional dimension of the pre-mixing chamber, or all of the fuel outlet openings of each peg may be formed within a center two-thirds of a cross-sectional dimension of the pre-mixing chamber. Alternate ones of the plurality of fuel outlet openings may be disposed in a respective fuel peg at respective positive and negative angles relative to a plane extending in a direction of the wake. A gas turbine engine including such a two-stage burner is also described.

BRIEF DESCRIPTION OF THE DRAWINGS

These and other advantages of the invention will be more apparent from the following description in view of the drawings that show.

DETAILED DESCRIPTION OF THE INVENTION

Figure 1:
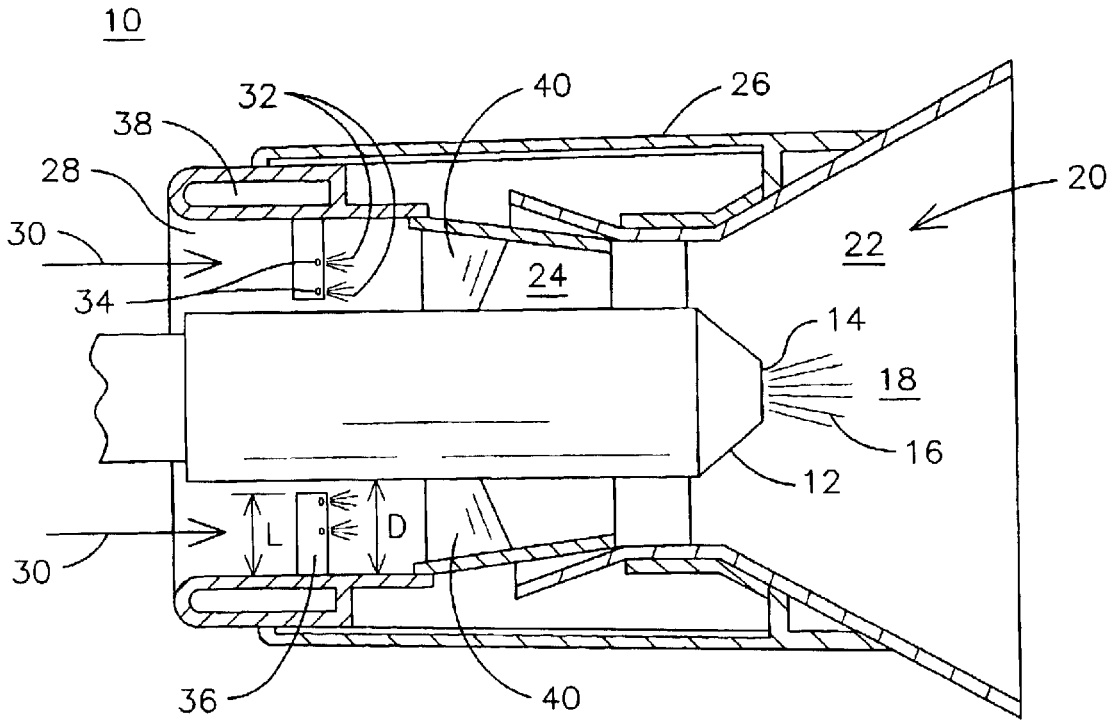
FIG. 1 is a partial cross-sectional view of a two-stage pilot burner for a gas turbine engine combustor.

The present inventors have recognized the importance of maintaining the velocity of the combustion air through a pre-mix burner of a gas turbine engine combustor in order to reduce the tendency of the burner to experience flashback of the flame from the combustion chamber into the pre-mixing chamber. A burner 10 having a reduced susceptibility to flashback is illustrated in FIG. 1. Burner 10 may be used as a pilot burner in a combustor of a gas turbine engine in combination with a plurality of pre-mix burners (not shown) disposed about the pilot burner 10 in a geometry well known in the art.

Burner 10 includes a centrally located diffusion burner 12 including internal fuel flow passages for delivering a flow of fuel to a diffusion fuel outlet opening 14. The diffusion fuel 16 exiting the diffusion fuel outlet opening 14 is combusted in a diffusion zone 18 of combustion chamber 20.

Burner 10 also includes a pre-mix zone 22 of combustion chamber 20. A mixture of fuel and air is delivered to the pre-mix zone 22 from pre-mixing chamber 24. Pre-mixing chamber 24 is an annular passage surrounding diffusion burner 12 and defined by pressure boundary structures including casing 26. Pre-mixing chamber 24 has an inlet end 28 for receiving a flow of compressed air 30 from a compressor section of the gas turbine engine (not shown). A flow of fuel 32 is introduced into the pre-mixing chamber 24 for mixing with the air 30 to form a combustible mixture for delivery to the combustion chamber 20. The fuel 32 is delivered through a plurality of pre-mix fuel outlet openings 34 formed in a plurality of fuel pegs 36 projecting into the pre-mixing chamber 24. The fuel pegs 36 are generally tubular shaped members having a length L extending along a longitudinal axis into the flow of air 30. The fuel pegs 36 may be supported in cantilever fashion with a length L less than a diameter dimension D of the pre-mixing chamber 24, or they may be supported at both ends in which case their length L would equal dimension D. Cantilever fuel pegs may be supported from the hub end (center) or from the shroud end (periphery). Fuel is supplied to the fuel pegs 36 of FIG. 1 from a peripherally mounted fuel supply ring 38. A plurality of swirler blades 40 are disposed across the flow path of the air 30 within pre-mixing chamber 24 in order to impart a swirling flow pattern to the air in order to promote mixing of the fuel 32 and air 30. One skilled in the art may appreciate that the swirler blades may be located upstream of the fuel pegs 36 rather than in the downstream location illustrated in FIG. 1. Furthermore, the structure used to direct the flow of air 30 and to define the chamber 24 within which fuel peg 36 is located may take other shapes, and the relative location and geometries of the various components may be altered to accommodate a particular burner design.

Figure 2:
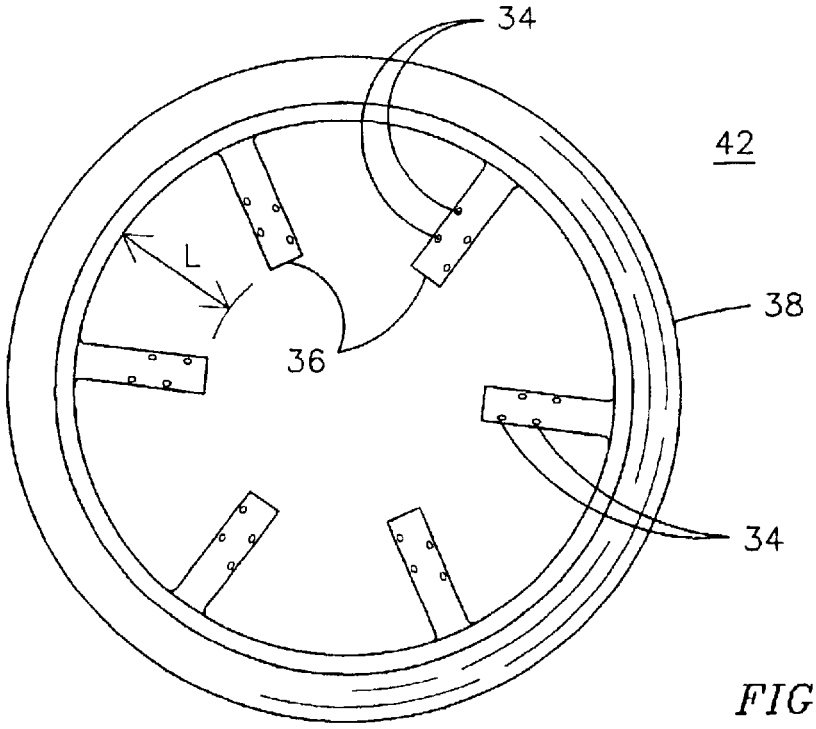
FIG. 2 is a plan view of the pre-mixer of the burner of FIG. 1.

The plurality of fuel pegs 36 and associated fuel supply ring 38 may be manufactured as an integral assembly referred to as a pre-mixer 42, as illustrated in FIG. 2. FIG. 2 is a view of pre-mixer 42 as seen when removed from burner 10. Pre-mixer 42 includes the plurality of peripherally fed fuel pegs 36. Each fuel peg includes a plurality of fuel outlet openings 34 formed therein. The location of the fuel outlet openings 34 along the length of the respective fuel pegs 36 may be selected to concentrate the flow of pre-mixing fuel 32 toward a center portion of the cross-sectional dimension D of the annular pre-mixing chamber 24. In one embodiment, a majority (greater than half) of the fuel outlet openings 34 formed in a fuel peg 36 are positioned to be within a center half of the cross-sectional dimension D of the pre-mixing chamber 24, i.e. the center D/2 portion of dimension D. In another embodiment, all of the fuel outlet openings 34 are positioned within a center two-thirds of the dimension D of the pre-mixing chamber 24. This may be accomplished with a cantilever fuel peg design by placing all of the fuel outlet openings 34 on the half of the fuel peg 36 that is away from its connected end. In this manner, it is possible to minimize the amount of fuel impinging upon the bounding walls of the diffusion burner 12 and casing 26 that define the pre-mixing chamber 24. This is important because any fuel entrained on such surfaces can promote flame holding on the surfaces that, in turn, will promote the occurrence of flashback. Similarly, the angular clocking of the position of the fuel pegs 36 may be selected to minimize the impingement of the fuel 32 onto downstream swirler blades 40.

It is known to form the fuel outlet openings of prior art fuel pegs so that they direct the flow of fuel directly downstream (down wind) of the fuel peg or normal (perpendicular) to the flow direction. Note that the presence of a swirler vane upstream of the fuel peg may cause the direction of the flow of air over the fuel peg to be in a direction that is not parallel to the longitudinal centerline of the burner. See, for example, the fuel injectors of FIG. 2 of U.S. Pat. No. 5,685,139 that appear to be angled away from the axis of the nozzle body but that are actually pointed normal to the flow direction due to the action of the swirler. It is also known in the prior art to provide a fuel injection orifice that is directed in an upwind direction to promote mixing by increasing the relative velocity between the fuel and the air. See, for example, FIG. 4 of U.S. Pat. No. 6,070,410.

Figure 3:
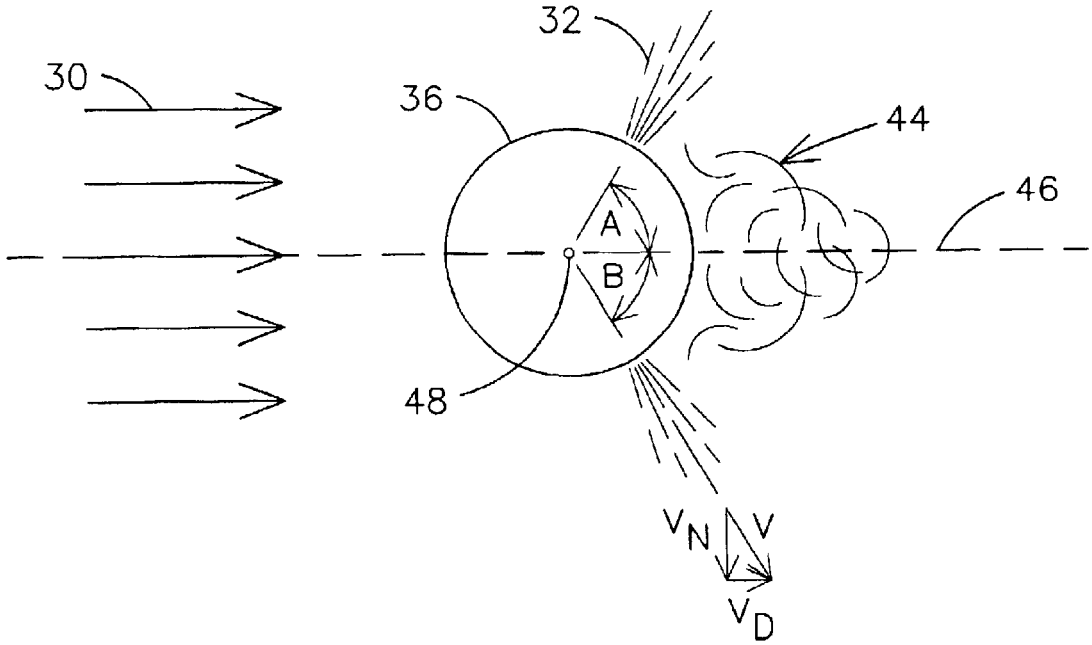
FIG. 3 is an end view of one of the fuel pegs of the pre-mixer of FIG. 2.

The present inventors have found that the flashback resistance of a burner may be improved by forming the fuel outlet openings 34 of a fuel peg 36 to direct the flow of fuel 32 in a downstream direction transverse to a direction of the flow of air past the fuel peg. Such an arrangement is provided on fuel peg 36 of pre-mixer 42 as may be appreciated by viewing FIGS. 2 and 3. FIG. 3 illustrates an end view of one of the fuel pegs 36 disposed in the flow of air 30. The presence of the fuel peg 36 creates a wake 44 extending downstream of the peg 36. Wake 44 exists along the length L of the fuel peg 36 and it extends away from the fuel peg 36 in a downstream direction that locates a plane 46. Plane 46 includes the longitudinal axis 48 of the fuel peg 36 and extends in the direction of the flow of air 30. The present invention seeks to minimize the areas of low flow velocity in the flow of air 30, and to minimize the amount of fuel present in low flow areas, since areas of low flow velocity are more susceptible to the back-propagation of a flame, thereby promoting flashback. One such low flow velocity area is wake 44. Note that injection of gas normal to the flow direction also creates a wake and the fuel starts with no downstream axial velocity. Because of the turbulence caused by the passage of air 30 over fuel peg 36, the net velocity in the direction of the flow of the air 30, as indicated by the arrows of FIG. 3, is lowest in the area of wake 44. The fuel outlet openings 34 are oriented on fuel peg 36 to deliver the flow of fuel 32 in a downstream direction transverse to a direction of the flow of air 30 past the fuel peg 36, i.e. transverse to plane 46, in order to direct the flow of fuel 32 away from wake 44. In one embodiment, the fuel outlet openings 34 are disposed at a nominal angle of 45° relative to plane 46 and to the direction of the flow of air 30 past the fuel peg 36. The term nominal angle is used herein to include the specified angle plus or minus normal manufacturing tolerances as are known in the art. In other embodiments, a fuel outlet opening 34 may be formed in the fuel peg 36 to direct the fuel 32 at any angle within 45° plus or minus 5°, or 45° plus or minus 10°, or 45° plus or minus 15° relative to the direction of the flow of air 30 past the fuel peg 36. Recall that these angles relate to the direction of the flow of air 30 and not necessarily to the axis of the burner, since the presence of a flow swirler 40 may cause the air 30 to be swirling within the pre-mixing chamber 24.

The velocity of the fuel 32 exiting fuel outlet opening 34 will be higher than the velocity of the air 30, limited only by the supply pressure and maximum flow required. A prior art design that directs fuel in a generally upstream or normal direction in order to promote mixing does so at the expense of locally decreasing the velocity of the air. The present invention avoids this local air velocity decrease by directing the fuel in a generally downstream direction, i.e. having a velocity component in the direction of the flow of air 30, thereby allowing the velocity of the fuel 32 to add to the downstream velocity of the air 30. A prior art design that directs fuel directly downstream into the wake will not slow the velocity of the air, however, it does create a locally rich fuel mixture in a low flow velocity zone proximate the fuel peg, thus creating conditions that are likely to hold a flame and to promote flashback. By directing the fuel 32 in a generally downstream direction transverse to the direction of the flow of air 30, the present invention increases the net velocity of the air 30 while avoiding the creation of a fuel-rich zone within the wake 44. The fuel 32 exiting the fuel peg 36 in a generally downstream direction has a velocity V that includes both a downstream velocity component $V_D$ and a velocity component $V_N$ that is normal to the downstream direction. In the embodiment where the angle A is 45°, these two components $V_D$ and $V_N$ are equal.

FIGS. 2 and 3 also illustrate that alternate ones of the fuel outlets 34 along the length L of the fuel pegs 36 are disposed at respective positive and negative angles A, B relative to plane 46, i.e. on opposed sides of the direction of the flow of air 30 past the fuel peg 36. This arrangement tends to reduce the magnitude of the wake 44. The high velocity jet of fuel 32 exiting fuel peg 36 will create a blockage that deflects the air stream. As there is no jet on the other side of the peg at the same radial location, the blockage deflects flow and tends to close down the wake 44 in that local area. In addition, the high velocity of the jet of fuel 32 will tend to reduce the size of the wake 44 as the high-speed jet of fuel 32 transfers momentum and accelerates the slower air 30. A similar perturbation of wake 44 will occur along length L proximate each fuel outlet opening 34. When alternate fuel outlet openings 34 are disposed at respective positive and negative angles A, B relative to plane 46, their combined effect is to minimize the size of wake 44 and to reduce its ability to act as a path for a back-propagation of flame. Thus, the alternating angles A, B of the fuel outlet openings 34 serves to further reduce the flashback risk of a burner 10 incorporating such fuel pegs 36.

While the preferred embodiments of the present invention have been shown and described herein, it will be obvious that such embodiments are provided by way of example only. Numerous variations, changes and substitutions will occur to those of skill in the art without departing from the invention herein. Accordingly, it is intended that the invention be limited only by the spirit and scope of the appended claims.

We claim as our invention:

1. A burner for a gas turbine engine, the burner comprising:

a pre-mix chamber for directing a flow of air;

a fuel peg extending into the flow of air, the flow of air past the fuel peg defining an upstream direction and a downstream direction; and a fuel outlet formed in the fuel peg for delivering a flow of fuel in a downstream direction transverse to the direction of the flow of air past the fuel peg.

2. The burner of claim 1, wherein the fuel outlet is formed to direct the flow of fuel at a nominal 45° angle relative to a plane extending in a direction of a wake formed downstream of the fuel peg.

3. The burner of claim 1, wherein the fuel outlet comprises an opening formed in the fuel peg at an angle of 45° plus or minus 5° relative to a plane extending in a direction of a wake formed downstream of the fuel peg.

4. The burner of claim 1, wherein the fuel outlet comprises an opening formed in the fuel peg at an angle of 45° plus or minus 10° relative to a plane extending in a direction of a wake formed downstream of the fuel peg.

5. The burner of claim 1, wherein the fuel outlet comprises an opening formed in the fuel peg at an angle of 45° plus or minus 15° relative to a plane extending in a direction of a wake formed downstream of the fuel peg.

6. The burner of claim 1, further comprising a plurality of fuel outlets formed along a length of the fuel peg, alternate ones of the fuel outlets being disposed at respective positive and negative angles relative to a plane extending in a direction of a wake formed downstream of the fuel peg.

7. The burner of claim 1, further comprising a plurality of fuel outlets formed along a length of the fuel peg, each fuel peg delivering fuel in a respective downstream direction transverse to a plane extending in a direction of a wake formed downstream of the fuel peg.

8. A two-stage burner for a gas turbine engine, the burner comprising:

a diffusion burner;

a structure disposed about the diffusion burner defining an annular pre-mixing chamber around the diffusion burner for the passage of a flow of air, a plurality of fuel pegs extending into the pre-mixing chamber; and a plurality of fuel outlet openings formed in each fuel peg, each fuel outlet opening directing a flow of fuel into the pre-mixing chamber in a generally downstream direction at an angle transverse to a direction of the flow of air past the respective fuel peg to direct the flow of fuel away from a wake formed in the flow of air downstream of the respective fuel peg.

9. The burner of claim 8, further comprising a fuel outlet opening formed in a respective fuel peg at a nominal 45° angle relative to a plane extending in a direction of the wake.

10. The burner of claim 8, further comprising a fuel outlet opening formed in a respective fuel peg at an angle of 45° plus or minus 5° relative to a plane extending in a direction of the wake.

11. The burner of claim 8, further comprising a fuel outlet opening formed in a respective fuel peg at an angle of 45° plus or minus 10° relative to a plane extending in a direction of the wake.

12. The burner of claim 8, further comprising a fuel outlet opening formed in a respective fuel peg at an angle of 45° plus or minus 15° relative to a plane extending in a direction of the wake.

13. The burner of claim 8, further comprising a majority of the fuel outlet openings of each peg formed within a center half of a cross-sectional dimension of the pre-mixing chamber.

14. The burner of claim 8, further comprising all of the fuel outlet openings of each peg formed within a center two-thirds of a cross-sectional dimension of the pre-mixing chamber.

15. The burner of claim 8, further comprising alternate ones of the plurality of fuel outlet openings formed in a respective fuel peg being disposed at respective positive and negative angles relative to a plane extending in a direction of the wake.

16. The burner of claim 8, further comprising a swirler blade disposed in the pre-mixing chamber to impart a swirling flow pattern to the flow of air in the pre-mixing chamber.

17. A gas turbine engine comprising the two-stage burner of claim 1.

18. The burner of claim 1, wherein the flow of fuel has a velocity V exiting the fuel outlet that is sufficiently high so that a velocity component $V_D$ in the direction of the flow of air past the fuel peg adds to the downstream velocity of the flow of air.

* * * * *